United States Patent [19]

Viessmann

[11] 4,169,431

[45] Oct. 2, 1979

[54] BOILER

[76] Inventor: Hans Viessmann, Im Hain, D3559 Battenberg, Eder, Fed. Rep. of Germany

[21] Appl. No.: 905,753

[22] Filed: May 15, 1978

Related U.S. Application Data

[63] Continuation-in-part of Ser. No. 839,579, Oct. 5, 1977.

[30] Foreign Application Priority Data

May 14, 1977 [DE] Fed. Rep. of Germany ..... 2721893
May 14, 1977 [DE] Fed. Rep. of Germany ..... 2645717

[51] Int. Cl.[2] ..... F22B 7/00
[52] U.S. Cl. ..... 122/136 R; 122/367 C
[58] Field of Search ..... 122/136 R, 136 C, 37, 122/149, 367 R, 367 C, DIG. 16

[56] References Cited

U.S. PATENT DOCUMENTS

| | | | |
|---|---|---|---|
| 2,123,444 | 7/1938 | Thibaudeau | 122/149 |
| 2,736,298 | 2/1956 | Smith | 122/DIG. 16 |
| 3,007,457 | 11/1961 | Ospelt | 122/37 |
| 3,601,097 | 8/1971 | Viessmann | 122/37 |
| 4,102,309 | 7/1978 | Viessmann | 122/136 |

*Primary Examiner*—Kenneth W. Sprague
*Attorney, Agent, or Firm*—Kurt Kelman

[57] ABSTRACT

The fire box unit inserted into a water casing of a boiler includes a tubular cast iron body fluid-tightly mounted in the apertures of the end walls of the steel sheet casing. The cast iron body is shaped to converge frustoconically from its inlet to its outlet end and has a plurality of radially inwardly extending webs. A combustion chamber shell is mounted in the inlet end of the cast iron body and has a fuel burner inlet for burning a fuel in the chamber defined by the shell. A closure wall opposite the fuel burner inlet deflects the combustion gases of the burnt fuel towards the fuel burner inlet where the deflected gases are received in a gas guide chamber. The shell with the gas guide chamber and a gas collecting chamber adjacent the closure wall at the outlet end of the cast iron body is supported on the webs and defines therewith gas flues leading from the gas guide to the gas collecting chamber. The gases in the flues heat the water in the casing and condensate tends to form in the bottom region of the tubular cast iron body protruding beyond the end walls of the casing. A shoulder damming the flow of the condensate in the gas flues in the end regions.

10 Claims, 7 Drawing Figures

BOILER

This is a continuation-in-part of my copending U.S. patent application Ser. No. 839,579, filed Oct. 5, 1977.

The present invention relates to improvements in the boiler for heating water, disclosed in my copending application. This boiler comprises a casing for holding the water to be heated and including two end walls defining apertures and a side wall extending between the end walls, the casing walls being of steel sheet. A fire box unit is inserted in the casing and includes a tubular cast iron body mounted fluid-tightly in the apertures of the end walls of the casing, the cast iron body having an inlet end and an outlet end protruding beyond the end walls and having a plurality of radially inwardly extending webs distributed over the circumference of the tubular body. A combustion chamber shell is mounted in the inlet end of the tubular cast iron body, the shell having a fuel burner inlet for burning a liquid or gaseous fuel in the combustion chamber defined by the shell and a closure wall opposite the fuel burner inlet whereby the combustion gases of the burnt fuel are deflected back towards the fuel burner inlet. A gas guide chamber at the fuel burner inlet receives the deflected gases and a gas collecting chamber is adjacent the closure wall at the outlet end of the cast iron body. The shell with the gas guide and collecting chambers is supported on the radially inwardly extending webs of the cast iron body and defines therewith gas flues leading from the gas guide to the gas collecting chamber.

The points of connection between the cast iron body and the steel sheet casing are not machined and the good malleability of the sheet steel is combined with the cast iron body so that no welding is required for providing a fluid tight connection therebetween while the integral casting of the radial webs with the tubular body provides the required ducts for the flue gases.

The combination of a steel sheet casing holding the water and a cast iron fire box unit inserted therein has the advantage that the casing may be readily connected to one or more hot water storage chambers, which is practically impossible with an all-cast iron boiler because of the resultant complexity of the castings and the problems of providing fluid tight connections. Furthermore, this combination makes it possible to arrange several superposed cast iron fire box inserts in the water casing and to operate with separate fuel burners so that it is possible to operate a selected number of these units, depending on the hot water requirements.

Operation of this advantageous boiler disclosed in my copending application has shown that, while the gases in the flues heat the water in the casing, condensate tends to form in a bottom region of the protruding ends of the tubular cast iron body in the gas flues.

In accordance with this invention, the boiler has been improved by shaping the tubular cast iron body to converge frusto-conically from the inlet towards the outlet end, and a shoulder dams the flow of the condensate in the bottom region of at least the protruding inlet end of the tubular cast iron body.

When a boiler of the indicated type is operated at different temperatures, a considerable amount of condensate will form in the ducts for the flue gases. It has proved to be very difficult to seal the connections between the end walls of the water casing and the fire box unit fluid tightly enough to prevent escape of condensate through the gasket. The condensate tends to corrode and destroy the gaskets since it consists of sulfuric acid or sulfurous acid. If it passes out of the gas flues, it will run down the steel sheet wall of the casing and destroy the same or the insulating jacket surrounding it.

The above and other objects, advantages and features of the invention will become more apparent from the following detailed description of certain now preferred embodiments thereof, taken in conjunction with the accompanying schematic drawing wherein FIG. 1 shows one embodiment of the boiler in longitudinal cross section through the axis of the boiler;

Figure 1:
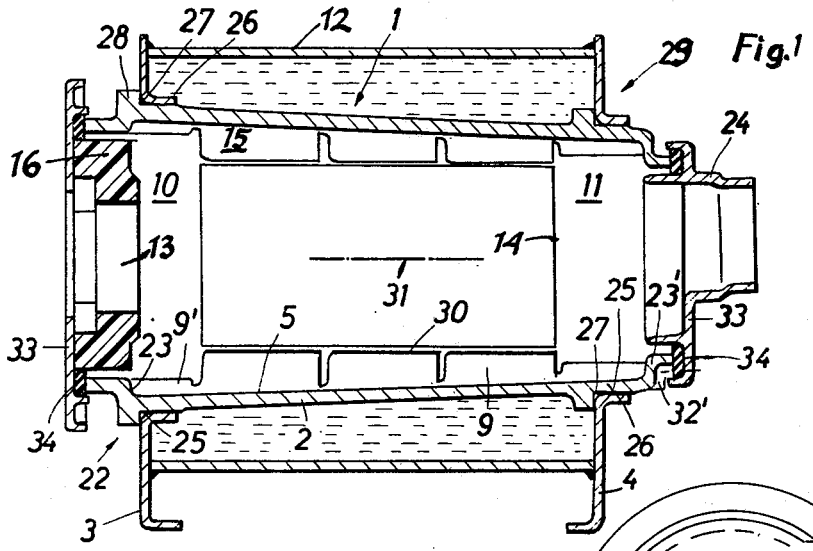

Referring now to the drawing wherein like reference numerals designate like parts functioning in a like manner in all figures, FIG. 1 shows the essential parts of a boiler for heating water according to the present invention. This boiler comprises casing 29 for holding water to be heated and including end walls 3 and 4 each defining central apertures arranged concentrically about axis 31 of the boiler and side wall 12 extending between the end walls. The casing walls are of steel sheet.

Figure 2:
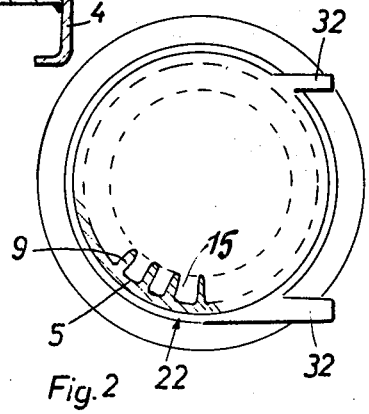
FIG. 2 is an end view of the boiler, partly in transverse cross section.

Fire box unit 1 is inserted in casing 29 and surrounded thereby. The first box unit includes tubular cast iron body 2 mounted fluid-tightly in the apertures of end walls 3, 4 of casing 29 in a manner to be described hereinafter. Cast iron body 2 is also arranged concentrically about boiler axis 31 and has inlet end 22 and an outlet end. The ends of the cast iron body protrude beyond end walls 3 and 4, and body 2 is shaped to converge frusto-conically from the inlet towards the outlet end. As best shown in FIG. 2, a plurality of radially inwardly extending webs 9 are distributed over the circumference of tubular body 2, projecting from interior wall 5 of cast iron body 2 and being cast integrally therewith.

Combustion chamber shell 7 is mounted in inlet end 22 of tubular cast iron body 2 and has a fuel burner inlet 13 for burning a gaseous or liquid fuel in the combustion chamber defined by shell 7 (the fuel burner not being shown). Closure wall 14 opposite fuel burner inlet 13 deflects the combustion gases of the burnet fuel back towards the fuel burner inlet where gas guide chamber 10 receives the deflected gases, this chamber having a somewhat larger diameter than the combustion chamber. Gas collecting chamber 11, which also has a larger diameter than the combustion chamber, is adjacent closure wall 14 at the outlet end of cast iron body 2. The shell with the gas guide and collecting chambers is supported on radially inwardly extending webs 9 of cast iron body 2 and defines therewith gas flues 15 leading from gas guide chamber 10 to gas collecting chamber 11. In view of the enlarged diameters of the gas guide and collecting chambers, webs 9 are higher in the center region supporting the portion of shell 7 defining the combustion chamber than in the end regions 9' of the webs so that ends 30 of the webs support the shell in the cast iron body, the shell being readily removably by sliding it along the supporting ends of the webs which hold the shell in position. The shell may be of stainless steel.

The hot gases flowing in flues 15 from guide chamber 10 to collecting chamber 11 heat the water in the annular chamber defined between tubular cast iron body 2 and casing 29. Particularly when the boiler is operated at changing temperatures, condensate will inevitably tend to form in the bottom region of the tubular cast iron body in the gas flues. To prevent such condensate to reach gaskets 34 which are interposed as a fluid-tight seal between the inlet and outlet ends of the cast iron body and closures 33 mounted thereover, shoulder 23 dams the flow of the condensate in the bottom region of the protruding inlet end 22 of the tubular cast iron body, the illustrated embodiments showing a like condensate damming shoulder 23' at the outlet end.

In the embodiment of FIG. 1, closure 33 at the outlet end is integral with flue connection 24 for removing the flue gases from gas collecting chamber 11. Insulating collar 16 is mounted on inlet closure 33 and surrounds the fuel burner (not shown) whose flame projects therethrough.

In the absence of shoulders 23, 23', condensate would flow into contact with gaskets 34 and would eventually destroy them. The conicity of tubular cast iron body 2 assures flow of the condensate formed particularly in the bottom half of the boiler towards the inlet end whch is in contact with the hottest part of the combustion gases. This will facilitate evaporation of at least a portion of the condensate. The lower the temperature of the gases, the higher the degree of condensation, i.e. the flue gases tend to condensate mostly towards the outlet end, i.e. in the region of gas collecting chamber 11. Therefore, it is advantageous to assure flow of the condensate from that region towards the inlet end, i.e. into the gas guide chamber 10, wherein the temperature is hottest. As indicated, the conicity of the tubular cast iron body forces this condensate flow even if it extends only over ¾ or ⅔ of the length of tubular body 2 and the remaining length of the body at the inlet end is cylindrical.

Figure 3:
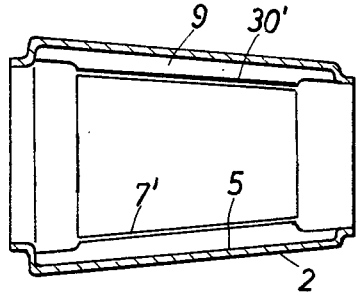
FIGS. 3, 4 and 5 are simplified longitudinal sections of modified embodiments of the boiler.
Figure 4:
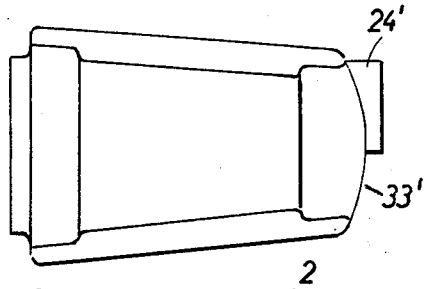

If the tubular cast iron body of the fire box unit is frusto-conical along its entire length, it may be useful to shape the central portion of the shell defining the combustion chamber accordingly. Such an embodiment is shown in FIGS. 3 and 4 where shell portion 7' is frusto-conical and extends parallel to tubular cast iron body 2. For this purpose, support ends 30' of radially extending webs 9 are similarly inclined from the inlet towards the outlet end so as to position shell 7' coaxially in the boiler.

Such a cast iron unit may be cast with a "green" core, i.e. the body would be shaped and cast vertically. Since all walls are conical and if the webs are thinner in front than in back, the form may be so prepared that the core is formed of sand in the interior. This makes it possible to cast the body with a substantially dome-shaped end wall 33' (see FIG. 4) at the outlet end thereby body 2 assumes a bell shape. A suitable opening may be cast into the dome-shaped end wall to receive flue 24' extending from the end wall for removing the gases from gas collecting chamber 11. The manufacturing cost of casting such a unit are less than when the tubular body has to be cast with separately prepared cores, which is necessary with cylindrical interiors.

The fire box unit is fluid-tightly connected with water casing 29 without welding, which is very advantageous because welding steel sheet to cast iron is rather difficult and does not assure a fluid tight seal in view of the difference in the thermal expansion coefficient between the two materials.

One preferred fluid-tight connection according to this invention is shown in FIG. 1. In this preferred embodiment of the connection, tubular cast iron body 2 has machined annular circumferential regions 25 and end walls 3, 4 of casing 29 having corresponding annular rims 26 forming a press or friction fit with the machined regions of the cast iron body. Sealing medium 27 forms a fluid-tight interface between the machined regions of the cast iron body and the annular rims of the steel sheet end walls. The sealing medium may be a heat- and liquid-resistant putty which also operates as a lubricant. To provide the required friction fit, the inner diameter of rim 26 is slightly less than the outer diameter of tubular body 2 at the machined regions. The cast iron body has annular collars 28 adjacent machined regions 25 to form abutments for end walls 3, 4 of the casing.

Figure 6:
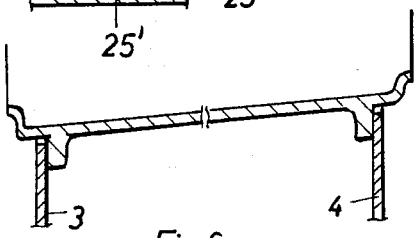
FIG. 6 is a partial longitudinal section of a portion of the boiler showing a modified detail.

FIG. 6 illustrates a less desirable fluid-tight connection wherein end walls 3, 4 of casing 29 are threadedly connected with annular collars of the cast iron body, with sealing rings or gaskets making the threaded connection fluid-tight. This produces a fluid-tight but detachable connection between the steel sheet walls of the casing and the cast iron body of the fire box unit.

To avoid subjecting steel sheet casing 29 to the load caused by mounting closures 33 on the boiler, cast iron body 2 is cast with parts 32, 32' for affixing the closures to the cast iron body, for example hingedly. In this manner, the cast iron body is the carrier of the boiler closures. This makes the entire manufacture of the boiler more economical.

Figure 5:
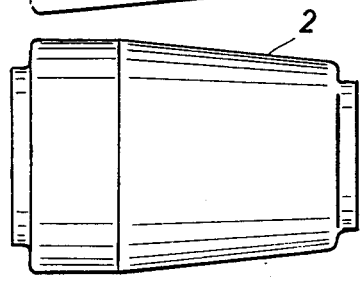

In the embodiment of FIG. 5, cast iron body 2 is shown to be conical only over part of its length while being cylindrical near the inlet end. In this embodiment, the shell defining the combustion chamber may be cylindrical, as in FIG. 1. As long as the tubular cast iron body tapers inwardly toward the outlet or colder end of the fire box unit, it has the advantage that the volume of the colder gas is reduced in relation to the volume of the hotter gas.

Figure 7:
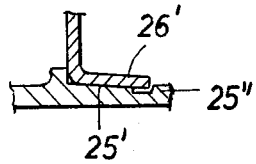
FIG. 7 is a like partial section illustrating another modified detail.

FIG. 7 shows a modified embodiment of the fluid-tight connection between steel sheet end walls 3, 4 and tubular cast iron body 2. In this embodiment, machined annular region 25' of tubular body 2 is frusto-conical and rim 26' of the end wall is correspondingly frusto-conical to provide a press or friction fit therebetween. The tubular body has a slight circumferential shoulder 25" spaced from machined region 25' by an annular groove. The outer diameter of shoulder 25" is between the inner and outer diameters of rim 26'. In this manner, when rim 26' is moved against collar 28 for frictional engagement with machined annular region 25', the rim snaps into position over shoulder 25" and is thus securely positioned. If any leak should even develop at this connection, it may be readily repaired by placing a sealing tape thereover.

While tubular body 2 has been illustrated as cylindrical, it may be oval in cross section.

What is claimed is:

1. A boiler for heating water, comprising
(a) a casing for holding the water to be heated and including
(1) two end walls each defining apertures and
(2) a side wall extending between the end walls, the casing walls being of steel sheet, and
(b) a fire box unit inserted in the casing and including
(1) a tubular cast iron body mounted fluid-tightly in the apertures of the end walls of the casing, the cast iron body having an inlet end and an outlet end protruding beyond the end walls, being shaped to converge frusto-conically from the inlet towards the outlet end, and having a plurality of radially inwardly extending webs distributed over the circumferences of the tubular body, and (2) a combustion chamber shell mounted in the inlet end of the tubular cast iron body, the shell having a fuel burner inlet for burning a fuel in the combustion chamber defined by the shell, a closure wall opposite the fuel burner inlet whereby the combustion gases of the burnt fuel are deflected back towards the fuel burner inlet, a gas guide chamber at the fuel burner inlet for receiving the deflected gases, a gas collecting chamber adjacent the closure wall at the outlet end of the cast iron body, the shell with the gas guide and collecting chambers being supported on the radially inwardly extending webs of the cast iron body and defining therewith gas flues leading from the gas guide to the gas collecting chamber, the gases in the flues heating the water in the casing and condensate tending to form in a bottom region of the tubular cast iron body in the gas flues, and a shoulder damming the flow of the condensate in the bottom region of at least the protruding inlet end of the of tubular cast iron body.

2. The boiler of claim 1, wherein the combustion chamber shell converges conically from the inlet towards the outlet end, the radially inwardly extending webs having support ends defining a correspondingly conical support for the shell.

3. The boiler of claim 1, wherein the cast iron body comprises a substantially dome-shaped end wall at the outlet end whereby the body assumes a bell shape, and further comprising a flue extending from the dome-shaped end wall for removing the gases from the collecting chamber.

4. The boiler of claim 1, wherein the cast iron body has machined annular circumferential regions and the end walls of the casing have corresponding annular rims forming a friction fit with the machined regions of the cast iron body.

5. The boiler of claim 4, further comprising a sealing medium forming a fluid-tightly interface between the machined regions of the cast iron body and the annular rims of the steel sheet end walls.

6. The boiler of claim 4, wherein the cast iron body has annular collars adjacent the machined regions to form abutments for the end walls of the casing.

7. The boiler of claim 1, wherein the cast iron body has annular collars for fluid-tightly but detachable connection with the steel sheet end walls of the casing.

8. The boiler of claim 1, wherein the tubular cast iron body comprises integrally cast parts at least at one of the ends thereof, and further comprising a closure affixed to the cast parts.

9. The boiler of claim 1, wherein the cast iron body has frusto-conical machined annular circumferential regions and the end walls of the casing have corresponding frusto-conical annular rims forming a friction fit with the machined regions, the tubular body also having circumferential shoulders spaced from the machined regions, the outer diameter of the shoulders being between the inner and outer diameters of the rims.

10. The boiler of claim 9, wherein the cast iron body defines an annular groove spacing the shoulder from the rim.

* * * * *